United States Patent [19]

Vass

[11] 4,192,631

[45] Mar. 11, 1980

[54] MINE ROOF SUPPORT METHOD AND APPARATUS

[75] Inventor: George S. Vass, Summersville, W. Va.

[73] Assignee: The Eastern Company, Naugatuck, Conn.

[21] Appl. No.: 905,125

[22] Filed: May 12, 1978

[51] Int. Cl.[2] ..... E21D 20/02

[52] U.S. Cl. ..... 405/261; 405/259

[58] Field of Search ..... 61/45 B; 85/1 R, 63; 405/259–262

[56] References Cited

U.S. PATENT DOCUMENTS

| | | | |
|---|---|---|---|
| 3,979,918 | 9/1976 | Vidler | 61/45 B |
| 4,051,683 | 10/1977 | Koval | 61/45 B |

*Primary Examiner*—David H. Corbin

*Attorney, Agent, or Firm*—Charles S. McGuire

[57] ABSTRACT

A rock formation, such as the roof of a mine tunnel, is reinforced by use of the apparatus of the invention to provide an anchor for a rock bolt which is tensioned to hold a support plate or similar structure in firm engagement with the face of the rock structure. The apparatus includes an elongated bar threadedly engaged with one end of a hollow collar, the other end of which is threaded to receive the rock bolt. An installation tool in the form of an elongated rod is provided at one end with outwardly extending fixed members for engagement with stop surfaces on the other end of the collar. Rotation of the tool is transmitted to the collar and bar to break a resin cartridge within a blind drill hole in the rock formation and mix the contents thereof. Upon hardening of the resin mixture about the bar, the installation tool is withdrawn and the rock bolt carrying a roof support plate is threaded into the anchored collar and tensioned to the desired degree.

10 Claims, 5 Drawing Figures

24
26
28
36
34
36

44
46
46

18, 20
22
24
38
10
14
42
40
12

18, 20
22
24
36
34
10
30
32
12
14
36

16
22
24
36
10
14
30
32
12
34
18
20

MINE ROOF SUPPORT METHOD AND APPARATUS

BACKGROUND OF THE INVENTION

The present invention relates to rock reinforcing systems and, more particularly, to roof bolting methods and apparatus wherein a bolt is tensioned by threading into an anchor which is secured within a drill hole by resin grouting.

Among the various types of mine roof support systems employing rock bolts anchored in bore holes are the purely mechanical or point-anchorage systems, the resin grouted systems, and combinations of the two wherein the bolt is tensioned by threading into a separate member which is anchored in the drill hole by resin grouting. In the usual mechanical anchorage systems an expansion anchor is placed on the threaded end of the bolt prior to insertion into the bore hole. As the bolt is advanced, the anchor expands to grip the inner surface of the drill hole and the bolt may be tensioned to the desired degree by applying sufficient torque. Although resin grouting systems wherein the bolt is anchored directly by a hardened resin mixture offer certain advantages, the bolt cannot be tensioned once the resin has set.

More recently roof support systems have been proposed wherein the advantages of the mechanical and resin anchorage systems are combined. Such systems are typefied by U.S. Pat. Nos. 3,877,235 of Hill and 4,051,683 of Koval, among others. In these systems an internally threaded member such as a nut or hollow collar is anchored within the drill hole by the resin mixture and the bolt is tensioned by threaded advancement into the anchored member. Stop means are provided to limit advancement of the bolt into the threaded member as the assembly is rotated to break the resin cartridge and mix the contents thereof. After the internally threaded member is anchored by the resin the stop means is fractured by application of sufficient torque to the bolt, which may then be tensioned to the desired degree.

While such systems are generally satisfactory for the intended purpose, there remains the possibility of malfunction due, for example, to premature fracture of the stop means which limits initial advance of the bolt into the internally threaded member as the resin cartridge is broken and its contents mixed. Also, since the bolt is assembled with the threaded member and elongated bar affixed thereto prior to insertion into the drill hole, the length of the total assembly is often too great to allow use thereof in confined spaces such as so-called "low coal".

It is a principal object of the present invention to provide novel and improved methods and apparatus for supporting a mine roof, or similar rock formation, by means of a tensioned bolt threaded into a resin anchored member within a drill hole.

A further object is to provide an anchoring assembly including an internally threaded member for receiving a rock bolt together with a removable installation tool for use in securing the assembly in a resin grouting.

Another object is to provide a method and apparatus for installing a mine roof bolt which can be employed in more confined spaces than similar prior art systems.

Still another object is to provide a mine roof support system wherein a rock bolt is tensioned by threaded advancement into a member anchored in resin grouting which requires no means for limiting initial advance of the bolt and requiring application of excess torque after the resin sets.

Other objects will in part be obvious and will in part appear hereinafter.

SUMMARY OF THE INVENTION

In accordance with the foregoing objects the invention contemplates a rock bolt assembly for use with a conventional, two-compartment resin package. An elongated bar, preferably in the form of a so-called rebar, is turned down to a smaller diameter end portion, which is externally threaded, forming a stepped shoulder at the juncture of the smaller and larger diameter portions. The rebar is advanced into one end of a hollow collar internally threaded at both ends until the stepped shoulder on the bar meets the end of the collar. The end of the collar opposite that into which the rebar is threaded is provided with stop surfaces in the form of slots or steps in the collar wall.

A separate installation tool is provided in the form of an elongated rod of smaller diameter than the opening at the slotted or stepped end of the collar. Fixed members extend outwardly from an end portion of the tool for engagement with the stop surfaces on the collar. In operation, the resin package is inserted into the previously formed drill hole and behind it the end of the rebar opposite the end to which the collar has been threadedly attached. When only the end of the collar having the stop surfaces is left outside the hole, the end of the installation tool having the fixed members is inserted in the collar and advanced into the drill hole.

The end of the tool outside the drill hole is provided with a head in the same manner as a bolt for engagement by a wrench. The tool is rotated as it is advanced into the hole, the rotation being transmitted to the collar through contact of the fixed members with the stop surfaces and thence to the rebar. When the resin cartridge is advanced to the inner end of the drill hole it is ruptured by further advancement of the rebar. The contents of the two compartments are mixed by continued rotation of the rebar. After a few second mixing is complete and rotation is halted.

When the resin grouting which now surrounds the rebar has hardened sufficiently to retain the rebar and collar in the hole the installation tool is removed and a standard rock bolt carrying a support plate is inserted into the hole. The bolt is rotated for threaded advancement into the anchored collar and tensioned to compress the rock strata around the drill hole, providing a reinforced rock formation.

DETAILED DESCRIPTION

Figures 1, 2, 3, 4, 5:
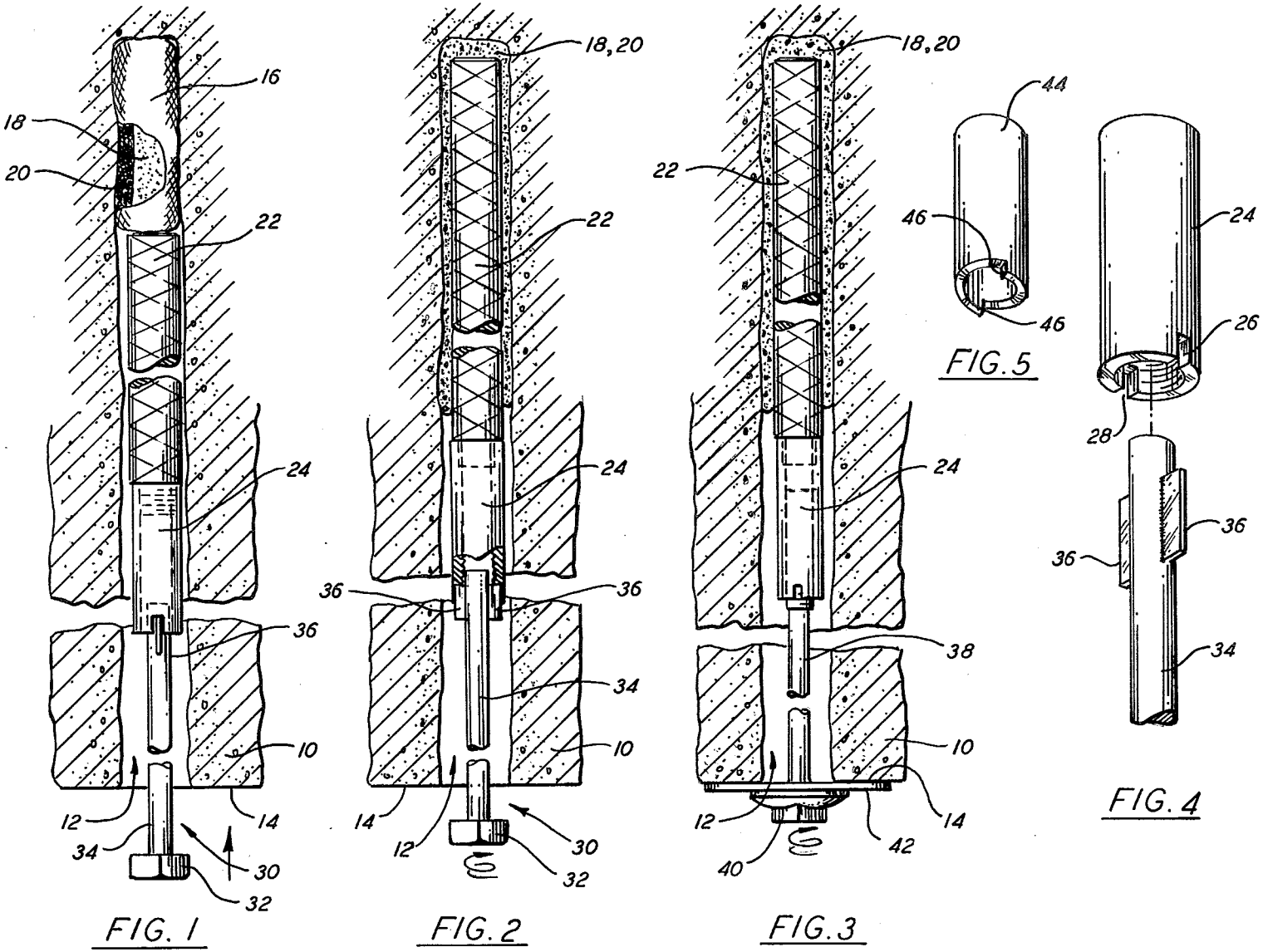
FIG. 1 is a cross sectional view through a rock formation having a drill hole formed therein showing, in front elevation, a conventional resin cartridge and the bolt anchoring apparatus of the invention at an initial stage of advancement by the installation tool.
FIG. 2 is a like view, showing the elements of FIG. 1 at a subsequent stage of the anchoring operation.
FIG. 3 is a like view, showing the elements in their final positions with the installation tool removed and replaced by a rock bolt supporting the rock structure.
FIG. 4 is a perspective view showing an end portion of the installation tool and a first embodiment of the collar.
FIG. 5 is a perspective view of a second embodiment of the collar.

Referring now to the drawing, in FIGS. 1–3 is shown a cross section of rock structure 10, such as the roof of a coal mine, in which blind drill hole 12 has been formed with conventional drilling tools for the purpose of installing elements which will serve to support surface 14 and generally reinforce the rock structure. Conventional resin cartridge 16 includes two compartments physically separating components 18 and 20 of a resin grouting mix. Such cartridges are commercially available from a variety of sources and include an epoxy or polyester resin as one of the components and a reaction agent such as a curing or hardening agent and/or a catalyst as the other. The two components remain in a semi-liquid or thixotropic phase until mixed, whereupon the resin begins to solidify. Curing and solidification continue until an extremely strong bond is formed.

As seen in FIG. 1, cartridge 16 has been placed in hole 12 and is supported therein on the free end of elongated bar 22, preferably of a type used in the reinforcement of concrete structures and therefore known as "rebar". The rebar has been turned down to a smaller diameter for a relatively short portion at one end. The smaller diameter portion is externally threaded for engagement in one end of an internally threaded, hollow, cylindrical collar 24. The juncture of the smaller and larger diameter portions of rod 22 form a stepped shoulder limiting the extent to which the rod may be threadedly advanced into collar 24.

The end of collar 24 opposite that into which bar 22 is threaded is formed with a pair of axially extending slots 26 & 28 (FIG. 4). Collar 24 is also threaded internally from the slotted end toward the center. In fact, collar 24 may be threaded along its entire length provided the threads are cut in the same direction (e.g., right-hand) from each end toward the center.

An installation tool, generally denoted by reference numeral 30, includes head 32, elongated shank 34 and fixed members in the form of ribs 36 extending radially therefrom near the end opposite head 32. In operation, cartridge 16 is inserted into drill hole 12, followed by bar 22 with collar 24 threadedly attached thereto. The end of shank 34, having a diameter less than that of the slotted end of collar 24 is inserted into the end of the collar and rotated as necessary until ribs 36 are engaged in slots 26 and 28. Tool 30 is moved upwardly until cartridge 16 engages the blind end of drill hole 12, as shown in FIG. 1.

Tool 30 is then rotated, as upward motion is continued, the rotation being transmitted to collar 24 through engagement of ribs 36 in slots 26 and 28, and to bar 22 through its threaded engagement to the maximum extent possible with collar 25. Upward movement and rotation of bar 22 serves to break cartridge 16 and to mix components 18 and 20 thereof. The mixed components flow around bar 22, filling the space between the bar and the wall of drill hole 12, as seen in FIG. 2. Tool 30 is held in engagement with collar 24 until the resin grouting formed by mixed components 18 and 20 hardens sufficiently to hold bar 22 and collar 24 in hole 12, (usually only a few seconds) and is then removed.

After removal of tool 30, a conventional rock bolt is inserted into drill hole 12. The bolt is shown in FIG. 3 and includes elongated shank 38, threaded at one end, and head 40 which carries conventional support plate 42, having an opening through which bolt shank 38 extends. By the time the installation tool has been removed and the bolt inserted, the resin grouting will normally have hardened to the point that rotation of bar 22 and collar 24 is effectively restrained thereby. Therefore, the bolt may be threadedly advanced into the slotted end of the collar to bring support plate 42 into contact with surface 14, as shown in FIG. 3. The rock structure is reinforced through tensioning the bolt by application of the desired torque.

A second embodiment of threaded collar, denoted by reference numeral 44, is shown in FIG. 5. Instead of slots, one end of collar 44 is formed with twin spiral surfaces terminating in axially extending steps 46 on diametrically opposed sides of the collar. Rotation may thus be transmitted from installation tool 30 in the desired direction through contact of ribs 36 with steps 46 to break the resin cartridge and mix the contents thereof to anchor rod 22 firmly in drill hole 12. Rod 22 and the threaded end of bolt shank 38 are advanced into opposite ends of collar 44 in the same manner as in the previous embodiment.

What is claimed is:

1. A method of reinforcing a rock formation comprising the steps of:
   (a) drilling a blind hole of predetermined dimensions into a face of the rock formation;
   (b) inserting a destructible resin cartridge into said hole;
   (c) inserting an elongated anchor bar into said hole with the leading end of said bar engaging said cartridge;
   (d) said bar on its trailing end being affixed to an internally threaded collar having at least one slot extending axially from the open end thereof for a portion of its length at least partially through the wall thereof for effecting mutual rotational engagement therewith of one end of an elongated rod having a fixed member extending radially therefrom for engagement in said slot;
   (e) effecting said rotational engagement of said rod with said collar by inserting said fixed member into said slot;
   (f) advancing said rod, and thereby said bar and said cartridge, into said hole with the other end of said rod remaining outside said hole;
   (g) engaging said other end of said rod with torque-applying means to rotate said rod, and thereby said bar, while advancing said rod and bar into said hole to rupture said cartridge and mix the contents thereof to form a hardenable resin mixture;
   (h) stopping rotation for a period of time sufficient for the resin mixture to harden about said bar while maintaining said bar in engagement with said rotational engagement means;
   (i) removing said rod from said hole;
   (j) advancing the threaded end of an elongated headed bolt into said hole; and
   (k) engaging the headed end of said bolt with torque-applying means to advance said threaded end of said bolt into said internally threaded collar to engage the bolt head with structure engaging the face of said rock formation and tension said bolt to a desired degree.

2. A method of reinforcing a rock formation comprising the steps of:
   (a) drilling a blind hole of predetermined dimensions into a face of the rock formation;

(b) inserting a destructible resin cartridge into said hole;

(c) inserting an elongated anchor bar into said hole with the leading end of said bar engaging said cartridge;

(d) said bar on its trailing end being affixed to an internally threaded collar having at least one stop surface comprising a step extending axially of the collar wall at the open end thereof, opposite the end affixed to said bar, for effecting rotational engagement with said collar of an elongated rod having a fixed member extending radially from one end thereof by contact of said fixed member with said stop surface in one direction of rotation of said rod;

(e) effecting said rotational engagement of said rod with said collar by placing said fixed member in contact with said stop surface;

(f) advancing said rod, and thereby said bar and said cartridge, into said hole with the other end of said rod remaining outside said hole;

(g) engaging said other end of said rod with torque-applying means to rotate said rod, and thereby said bar, while advancing said rod and bar into said hole to rupture said cartridge and mix the contents thereof to form a hardenable resin mixture;

(h) stopping rotation for a period of time sufficient for the resin mixture to harden about said bar while maintaining said bar in engagement with said rotational engagement means;

(i) removing said rod from said hole;

(j) advancing the threaded end of an elongated headed bolt into said hole; and (k) engaging the headed end of said bolt with torque-applying means to advance said threaded end of said bolt into said internally threaded collar to engage the bolt head with structure engaging the face of said rock formation and tension said bolt to a desired degree.

3. The method according to claims 1 or 2 wherein said other end of said rod is headed and said torque-applying means comprises a wrench engageable with the head on said rod.

4. The method according to claim 1 wherein a pair of slots are formed in opposite sides of said collar and a pair of fixed members extend radially from opposite sides of said rod for respective engagement in said slots.

5. The method according to claim 2 wherein a pair of steps are provided in opposite sides of said collar wall and a pair of fixed members extend radially from opposite sides of said rod for respective contact with said steps.

6. Apparatus for installation in a drill hole in a rock formation to fracture a resin cartridge and mix the contents thereof, said apparatus thereafter being firmly anchored in the drill hole by the hardened resin mixture and serving to reinforce the rock formation, said apparatus comprising:

(a) an elongated anchor bar;

(b) a hollow collar carried by one end of said bar, said collar and said bar including means whereby the two are fixed against relative roation in one direction, and having an internally threaded portion coaxial with said bar;

(c) an installation tool comprising an elongate rod having a head on one end;

(d) at least one radially extending fixed member on the end of said rod opposite said one end and at least one slot extending axially of said collar at least partially through the wall thereof for engagement by said fixed member for transmitting rotation in one direction from said rod to said collar and thereby to said bar; and (e) an elongated bolt having a head on one end and threaded from the other end for engagement with said internally threaded portion of said collar subsequent to disengagement of said rod with said slot.

7. The invention according to claim 6 wherein a pair of said slots are formed in diametrically opposite portions of said collar wall, and rod opposite end portion includes a pair of said fixed members extending outwardly from diametrically opposite sides thereof for engagement with both of said slots.

8. Apparatus for installation in a drill hole in a rock formation to fracture a resin cartridge and mix the contents thereof, said apparatus thereafter being firmly anchored in the drill hole by the hardened resin mixture and serving to reinforce the rock formation, said apparatus comprising:

(a) an elongated anchor bar;

(b) a hollow collar carried by one end of said bar, said collar and said bar including means whereby the two are fixed against relative rotation in one direction, and having an internally threaded portion coaxial with said bar;

(c) an installation tool comprising an elongate rod having a head on one end;

(d) at least one radially extending fixed member on the end of said rod opposite said one end and at least one stop surface comprising an axially extending step in the collar wall at the open end thereof, opposite the end affixed to said bar, for effecting rotational engagement of said collar and rod in one direction by contact of said fixed member with said step for transmitting rotation in one direction from said rod to said collar and thereby to said bar; and (e) an elongated bolt having a head on one end and threaded from the other end for engagement with said internally threaded portion of said collar subsequent to disengagement of said rod with said step.

9. The invention according to claim 8 wherein a pair of said steps are formed in diametrically opposite portions of said collar wall, and said rod opposite end portion includes a pair of said fixed members extending outwardly from opposite sides thereof for respective contact with said steps upon rotation of said rod in said one direction.

10. The invention according to claim 8 or 9 wherein said steps are formed at the terminus of spiral surfaces in said open end of said collar wall.

* * * * *